US010479089B2

(12) United States Patent
Yoshii

(10) Patent No.: US 10,479,089 B2
(45) Date of Patent: Nov. 19, 2019

(54) SUPPLY LIQUID TANK UNIT AND INK JET RECORDING APPARATUS INCLUDING THE SAME

(71) Applicant: KYOCERA Document Solutions Inc., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/987,495

(22) Filed: May 23, 2018

(65) Prior Publication Data

US 2018/0345671 A1 Dec. 6, 2018

(30) Foreign Application Priority Data

Jun. 2, 2017 (JP) ..... 2017-110279

(51) Int. Cl.
*B41J 2/165* (2006.01)
*B41J 2/17* (2006.01)
(Continued)

(52) U.S. Cl.
CPC ..... *B41J 2/16552* (2013.01); *B41J 2/175* (2013.01); *B41J 2/1721* (2013.01); *B41J 2/1752* (2013.01);
(Continued)

(58) Field of Classification Search
CPC ..... B41J 2/17513; B41J 2/17566; B41J 2/17553; B41J 2/17523; B41J 2/1752; B41J 2/175; B41J 2/17509; B41J 2002/17573; B41J 29/13; B41J 2/19; B41J 2002/17579; B41J 29/393; B41J 2/1721; B41J 13/00; B41J 2/16552; B41J 2002/16558
(Continued)

(56) References Cited

U.S. PATENT DOCUMENTS 6,257,712 B1 7/2001 Haigo ..... 347/85
8,246,153 B2 8/2012 Miyajima ..... 347/92

FOREIGN PATENT DOCUMENTS

EP 0 803 364 A2 4/1997
EP 3 263 343 A1 1/2016
(Continued)

OTHER PUBLICATIONS

International Search Report dated Mar. 22, 2016, issued by the Japanese Patent Office in corresponding application PCT/JP2016/051446.
(Continued)

*Primary Examiner* — Jannelle M Lebron
(74) *Attorney, Agent, or Firm* — Stein IP, LLC

(57) ABSTRACT

The supply liquid tank unit of the disclosure includes a supply liquid tank, and a detection sensor. The detection sensor detects a liquid level of liquid in the supply liquid tank. The supply liquid tank includes a first chamber provided with an inflow port, a second chamber provided with an outflow port, a partition wall for partitioning the first chamber and the second chamber from each other, and a lower communicating path which is formed from a lower end of the partition wall and a lower surface of the supply liquid tank and which makes the first chamber and the second chamber communicating with each other. The detection sensor detects a liquid level of the liquid in the second chamber and is placed above the lower end of the partition wall.

13 Claims, 6 Drawing Sheets

(51) Int. Cl.

| | |
|---|---|
| ***B41J 2/175*** | (2006.01) |
| ***B41J 2/19*** | (2006.01) |
| ***B41J 13/00*** | (2006.01) |
| ***B41J 29/13*** | (2006.01) |

(52) U.S. Cl.
CPC ..... *B41J 2/17509* (2013.01); *B41J 2/17513* (2013.01); *B41J 2/17553* (2013.01); *B41J 2/17566* (2013.01); *B41J 2/19* (2013.01); *B41J 13/00* (2013.01); *B41J 29/13* (2013.01); *B41J 2002/16558* (2013.01); *B41J 2002/17573* (2013.01); *B41J 2002/17579* (2013.01)

(58) Field of Classification Search
USPC ..... 347/6, 7, 14, 19, 22, 29, 36, 84–86
See application file for complete search history.

(56) References Cited

FOREIGN PATENT DOCUMENTS

| | | | |
|---|---|---|---|
| JP | 2009-106833 | A | 5/2009 |
| WO | WO 2016/136333 | A1 | 9/2016 |

OTHER PUBLICATIONS

Extended European Search Report dated Sep. 19, 2018, issued by the European Patent Office in corresponding application EP 18175588.5.

SUPPLY LIQUID TANK UNIT AND INK JET RECORDING APPARATUS INCLUDING THE SAME

INCORPORATION BY REFERENCE

This application is based upon and claims the benefit of priority from the corresponding Japanese Patent Application No. 2017-110279 filed on Jun. 2, 2017, the entire contents of which are incorporated herein by reference.

BACKGROUND

The present disclosure relates to a supply liquid tank unit which includes a supply liquid tank for containing liquid to be supplied to recording heads that eject ink to a recording medium such as a paper sheet, and a detection sensor for detecting a liquid level of the liquid in the supply liquid tank. The disclosure also relates to an ink jet recording apparatus including the supply liquid tank unit.

As a recording apparatus such as facsimiles, copiers and printers, ink jet recording apparatuses that eject ink to form images have been widely used by virtue of their capability of high-definition image formation.

With such an ink jet recording apparatus, there may occur deterioration of ink traveling-straightness (curved flies), non-ejection of ink or the like, leading to degraded printing performance of the recording heads. The cause of this could be attributed to foreign matters such as paper powder generated during conveyance of paper sheets (recording medium) as well as dust and dirt, minute ink mist (hereinafter, referred to as mist) discharged along with ink drops for image recording, or to abnormal occurrence of menisci due to deposition of rebounded mist on ink ejection surfaces of the recording heads, the rebounded mist resulting when ink drops are deposited on the recording medium. Further, the cause could also be attributed to deterioration of sealability in a cap-fitted state due to deposition and drying of mist at the cap fitted portion, as well as to resultant occurrence of increases in viscosity of the ink within nozzles.

Accordingly, there has been known an apparatus featuring that, with the aim of cleaning each ink ejection surface of the recording heads, the ink ejection surface, after the supply of cleaning liquid thereto, is wiped off by a wiper while the wiper is holding the cleaning liquid, thereby fulfilling recovery process for the recording heads.

As such an ink jet recording apparatus as described above, there is known an ink jet recording apparatus which includes a cleaning liquid tank, and a detection sensor for detecting a liquid level of cleaning liquid in the cleaning liquid tank, the cleaning liquid tank having an inflow port for allowing inflow of the cleaning liquid and an outflow port for allowing outflow of the cleaning liquid. With this configuration, when the detection sensor has detected a liquid level of the cleaning liquid, the cleaning liquid is additionally supplied (resupplied) through the inflow port by a user or operator.

SUMMARY

A supply liquid tank unit according to a first aspect of the disclosure includes a supply liquid tank, and a detection sensor. The supply liquid tank contains liquid to be supplied to a recording head that ejects ink onto a recording medium. The detection sensor detects a liquid level of the liquid in the supply liquid tank. The supply liquid tank includes a first chamber provided with an inflow port allowing inflow of the liquid, a second chamber provided with an outflow port allowing outflow of the liquid, a partition wall for partitioning the first chamber and the second chamber from each other, and a lower communicating path which is formed from a lower end of the partition wall and a lower surface of the supply liquid tank and which makes the first chamber and the second chamber communicating with each other. The outflow port is placed below the detection sensor. The detection sensor detects a liquid level of the liquid in the second chamber, and is placed above the lower end of the partition wall.

Still further objects of the disclosure as well as concrete advantages obtained by the disclosure will become more apparent from an embodiment thereof described hereinbelow.

DETAILED DESCRIPTION

Hereinbelow, an embodiment of the present disclosure will be described with reference to the accompanying drawings.

Figure 1:
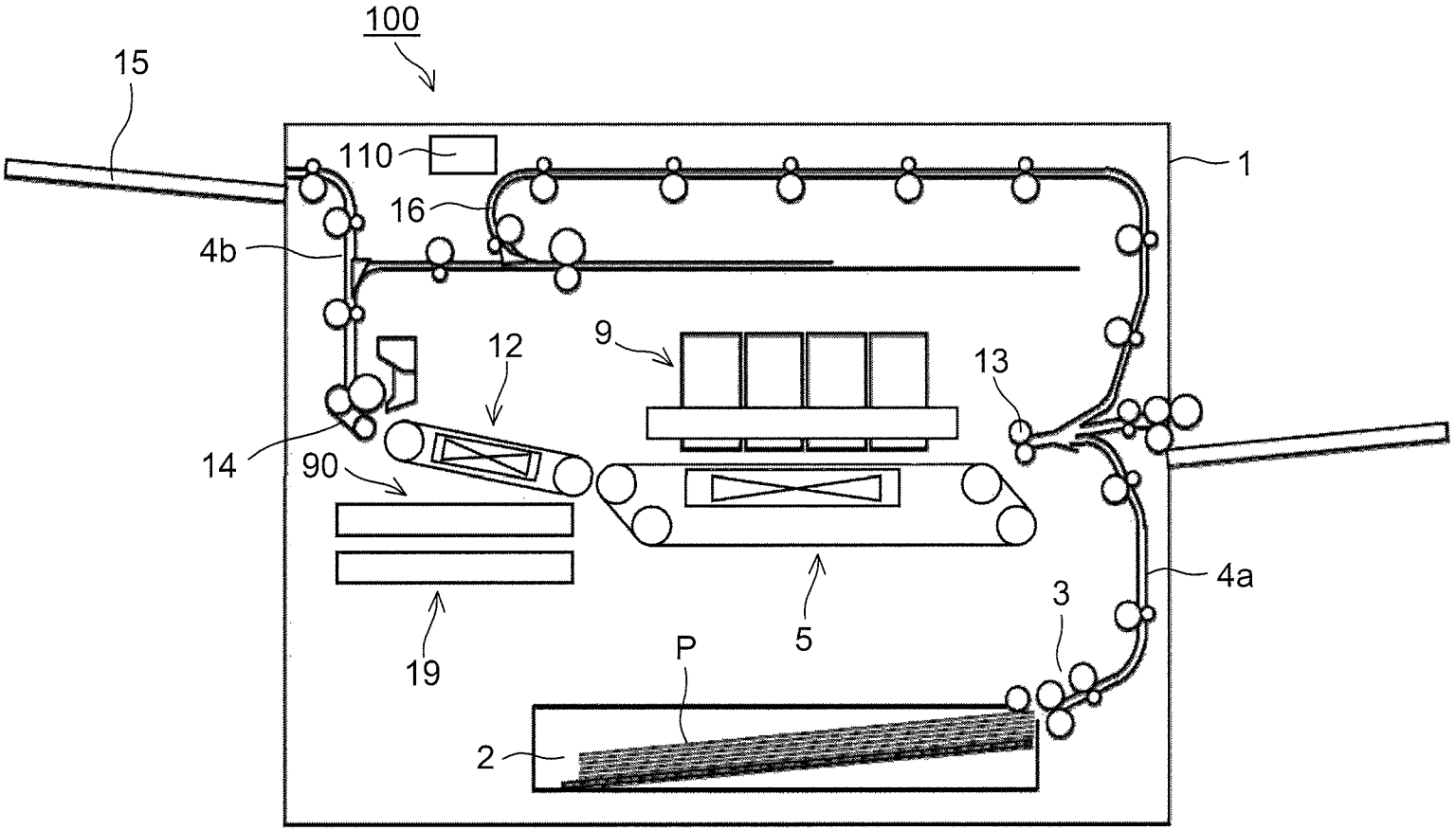
FIG. 1 is a view showing a configuration of an ink jet recording apparatus including a supply liquid tank unit according to one embodiment of the disclosure.

An ink jet recording apparatus 100 including a supply liquid tank unit 60 according to one embodiment of the disclosure will be described with reference to FIGS. 1 to 10. In the ink jet recording apparatus 100, as shown in FIG. 1, a sheet feed cassette 2 serving as a sheet housing part is placed below inside the apparatus body 1. Paper sheets P as an example of the recording medium are housed within the sheet feed cassette 2. A sheet feed device 3 is placed on an upper downstream side of the sheet feed cassette 2 in a sheet conveyance direction, i.e., on the upper right side of the sheet feed cassette 2 in FIG. 1. The sheet feed device 3 feeds out the paper sheets P, after separating those off one by one, toward the upper rightward side of the sheet feed cassette 2, as viewed in FIG. 1.

The ink jet recording apparatus 100 also includes a first sheet conveyance path 4*a* in its inside. The first sheet conveyance path 4*a* is located right upward of the sheet feed cassette 2, which corresponds to its sheet feed direction. A paper sheet P fed out from the sheet feed cassette 2 is conveyed upward along a side face of the apparatus body 1 by the first sheet conveyance path 4*a*.

A registration roller pair 13 is provided at a downstream end of the first sheet conveyance path 4*a* relative to the sheet conveyance direction. A first conveyance unit 5 and a recording part 9 are placed on the downstream side of the registration roller pair 13 in the sheet conveyance direction. The sheet P fed out from the sheet feed cassette 2 passes along the first sheet conveyance path 4*a* to reach the registration roller pair 13. While correcting a skew feed of the sheet P and concurrently measuring a timing for ink ejecting operation executed by the recording part 9, the registration roller pair 13 feeds out the sheet P toward the first conveyance unit 5.

A second conveyance unit 12 is placed on the downstream side (left side in FIG. 1) of the first conveyance unit 5 relative to the sheet feed direction. The sheet P having an ink image recorded thereon at the recording part 9 is fed to the second conveyance unit 12, where the ink ejected onto the sheet P surface is dried during the passage through the second conveyance unit 12.

A decurler part 14 is provided on the downstream side of the second conveyance unit 12 relative to the sheet conveyance direction and near the left side face of the apparatus body 1. The sheet P having its ink dried in the second conveyance unit 12 is fed to the decurler part 14, where curls having occurred to the sheet P are corrected.

A second sheet conveyance path 4*b* is provided on the downstream side (upward in FIG. 1) of the decurler part 14 relative to the sheet conveyance direction. The sheet P that has passed through the decurler part 14, when not subjected to double-side recording, is discharged from the second sheet conveyance path 4*b* to a sheet discharge tray 15 provided outside the left side face of the ink jet recording apparatus 100.

A reversal conveyance path 16 for fulfilling double-side recording is provided at a place which is an upper site in the apparatus body 1 and which is above the recording part 9 and the second conveyance unit 12. In a case where double-side recording is executed, the sheet P that is over the recording on a first surface and that has passed through the second conveyance unit 12 and the decurler part 14 passes through the second sheet conveyance path 4*b* so as to be fed to the reversal conveyance path 16. The sheet P fed to the reversal conveyance path 16 is switched over in conveyance direction for subsequent recording on a second surface. Then, the sheet P is fed rightward by passing through upper part of the apparatus body 1, and further fed via the first sheet conveyance path 4*a* and the registration roller pair 13 so as to be delivered again to the first conveyance unit 5 with the second surface facing upward.

A wipe unit 19 and a cap unit 90 are placed below the second conveyance unit 12. The wipe unit 19, for execution of later-described purge process, moves horizontally to under the recording part 9. The wipe unit 19 then wipes off ink extruded from ink ejection ports of the recording heads to collect up the wiped ink. The cap unit 90, for capping of an ink ejection surface of each recording head, moves horizontally to under the recording part 9 and further moves upward so as to be fitted to the lower surface of the recording head.

Figure 2:
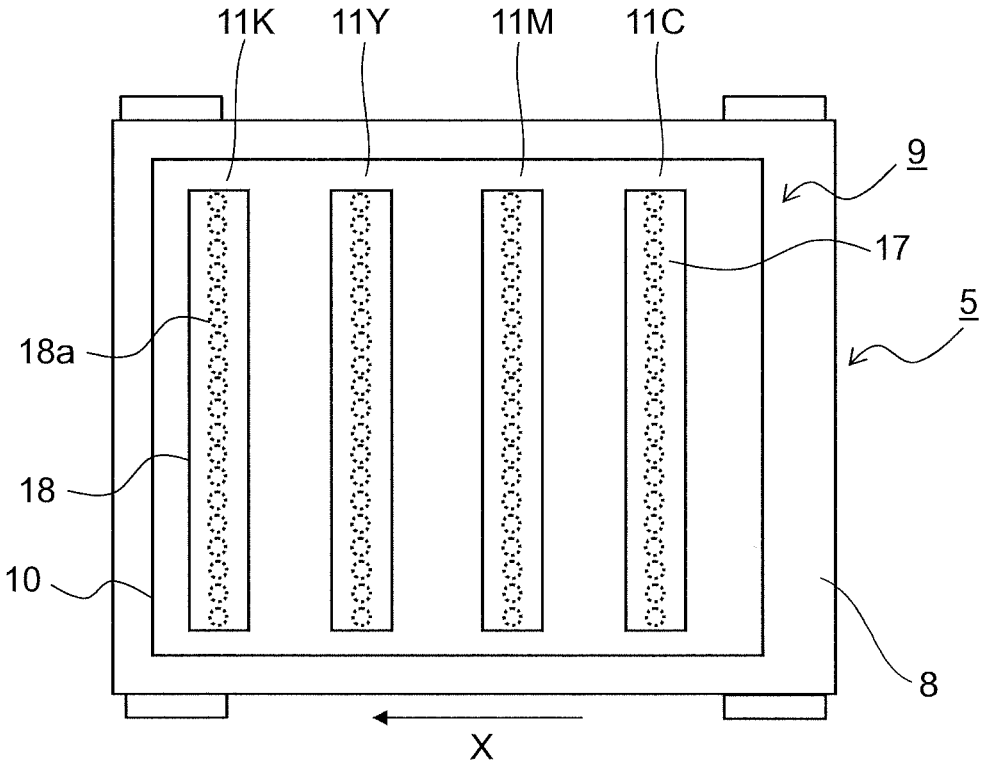
FIG. 2 is a view of a first conveyance unit and a recording part in the ink jet recording apparatus shown in FIG. 1, as viewed from above.

As shown in FIG. 2, the recording part 9 includes a head housing 10, and line heads 11C, 11M, 11Y, 11K held by the head housing 10. Each of these line heads 11C to 11K is formed by one or more (one in this case) recording head 17 which is supported at such a height that a specified gap (e.g., 1 mm) is formed against the conveyance surface of a first conveyor belt 8 in the first conveyance unit 5, and which extends along a sheet widthwise direction (up/down direction in FIG. 2) perpendicular to the sheet conveyance direction (arrow X direction).

Figure 3:
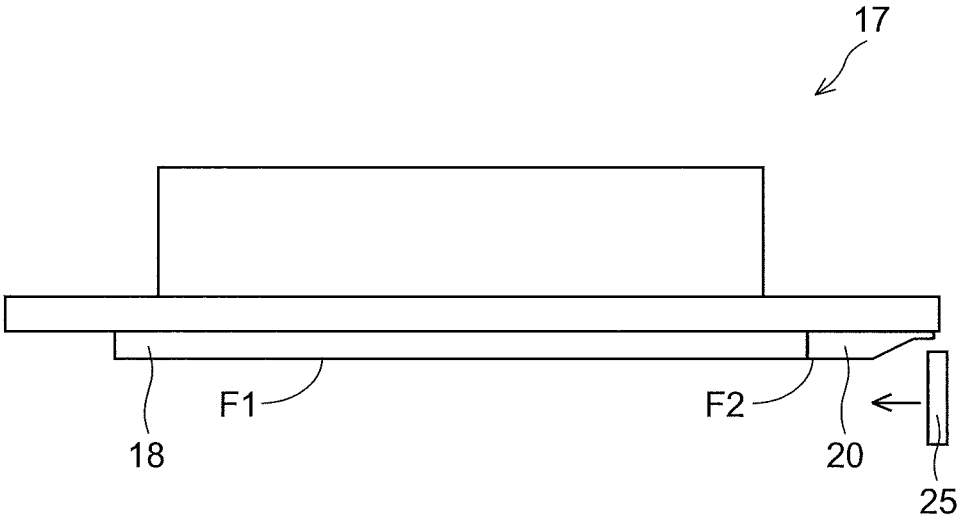
FIG. 3 is a view of a recording head including line heads in the recording part.
Figure 4:
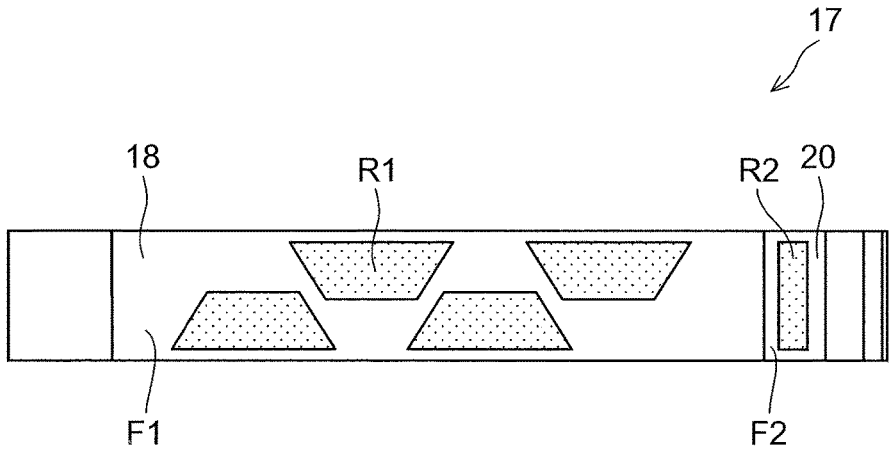
FIG. 4 is a view of the recording head as viewed from the ink ejection surface side.

As shown in FIGS. 3 and 4, ink ejection areas R1 in which a multiplicity of ink ejection ports 18*a* (see FIG. 2) are arrayed are provided on the ink ejection surface F1 of head portions 18 in the recording heads 17.

Four-color (cyan, magenta, yellow and black) inks stored in ink tanks (not shown) are supplied to the recording heads 17 including the line heads 110 to 11K, respectively, on a corresponding color basis.

In response to image data received from an external computer by control signals derived from a control unit 110 (see FIG. 1), each recording head 17 ejects ink from the ink ejection ports 18*a* toward the sheet P that is conveyed while sucked and held to the conveyance surface of the first conveyor belt 8. As a result, a color image in which four-color inks of cyan, magenta, yellow and black are superimposed together is formed on the sheet P set on the first conveyor belt 8.

A cleaning liquid supply member 20 for supply of cleaning liquid is also provided in each recording head 17. The cleaning liquid supply member 20 is placed in adjacency to an upstream side (right side in FIG. 3) of the head portion 18 in the wiping direction of a wiper 25. The cleaning liquid supply member 20 has a cleaning liquid supply surface F2 including a cleaning liquid supply area R2 in which a multiplicity of cleaning liquid supply ports for supply of the cleaning liquid are arrayed.

Figure 5:
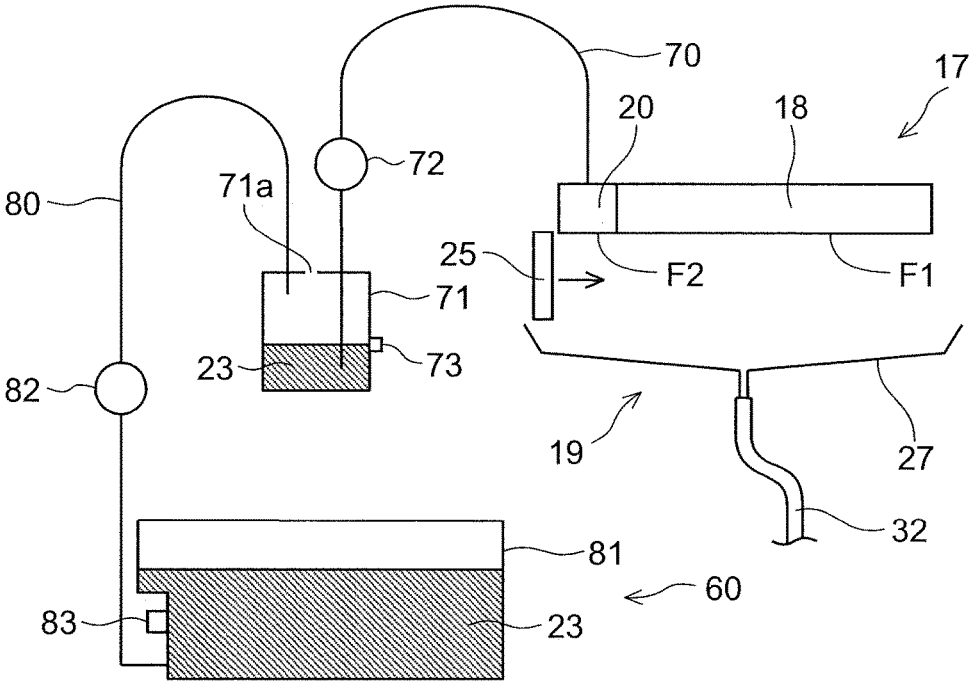
FIG. 5 is a view showing a configuration of around the recording head, a sub tank and a main tank.

As shown in FIG. 5, a downstream end of a cleaning liquid supply path 70 formed of a tube allowing passage of cleaning liquid 23 is connected to the cleaning liquid supply member 20. An upstream end of the cleaning liquid supply path 70 is connected to one sub tank 71 for storage of the cleaning liquid 23 that is to be supplied to the cleaning liquid supply member 20. A supply pump 72 for drawing up the cleaning liquid 23 from the sub tank 71 and feeding the liquid to the cleaning liquid supply member 20 is provided on the cleaning liquid supply path 70. In the figure, the cleaning liquid 23 is hatched for an easier understanding.

A downstream end of a cleaning liquid resupply path 80 formed of a tube allowing passage of the cleaning liquid 23 is connected to the sub tank 71. An upstream end of the cleaning liquid resupply path 80 is connected to a main tank (supply liquid tank) 81 for storage of the cleaning liquid 23 that is to be resupplied to the sub tank 71. A resupply pump 82 for drawing up the cleaning liquid 23 from the main tank 81 and feeding the liquid to the sub tank 71 is provided on the cleaning liquid resupply path 80. The supply pump 72 and the resupply pump 82 may be given by the use of tube pumps, syringe pumps, diaphragm pumps, or the like.

An atmospheric air opening 71*a* for equalizing the internal pressure of an internal space with the atmospheric pressure is provided in the sub tank 71. Also, a first detection sensor 73 for detecting a liquid level (top surface) of the cleaning liquid 23 is provided at a specified position in the sub tank 71. The first detection sensor 73 may be given, for example, by using a capacitance type, optical type, electrode type, or other type one. When a liquid absence is detected by the first detection sensor 73, the cleaning liquid 23 is resupplied from the main tank 81 to the sub tank 71 by the resupply pump 82 until a liquid presence is detected. As a lresult, the liquid level of the cleaning liquid 23 within the sub tank 71 is maintained at a generally constant height in the sub tank 71.

A second detection sensor 83 for detecting the cleaning liquid 23 is provided at a specified position in the main tank 81. The second detection sensor 83 may be given, for example, by using a capacitance type, optical type, electrode type, or other type one. In this case, a capacitance type detection sensor is used. When a liquid absence is detected by the second detection sensor 83, a notification that the main tank 81 has emptied is given on the display panel (not shown) of the ink jet recording apparatus 100. As a result, the cleaning liquid 23 is resupplied to the main tank 81 by the user or operator. A detailed configuration around the main tank 81 will be described later. It is noted that the second detection sensor 83 is an example of the 'detection sensor' of this disclosure.

In this ink jet recording apparatus 100, for cleanness of the ink ejection surface F1 of each recording head 17, a purge process of extruding ink of increased viscosity through the ink ejection ports 18*a* of the head portions 18 is executed at a printing start time after a long halt as well as during printing-operation intervals while the cleaning liquid 23 is supplied through cleaning liquid supply ports (not shown) of the cleaning liquid supply member 20. Then, the cleaning liquid supply surface F2 and the ink ejection surface F1 are wiped off by the wiper 25 of the wipe unit 19. In this process, waste ink and waste cleaning liquid wiped off by the wiper 25 are collected to a collection tray 27 (see FIG. 5) provided in the wipe unit 19, and stored via a waste ink tube 32 into a waste ink tank 40. This recovery operation for the recording head 17 is executed by controlling the recording head 17, the wipe unit 19, the supply pump 72 and the like based on control signals derived from the control unit 110 (see FIG. 1).

Next, the supply liquid tank unit 60 including the main tank 81 and the second detection sensor 83 for detecting a liquid level of the cleaning liquid (liquid) 23 in the main tank 81 will be described below.

Figure 6:
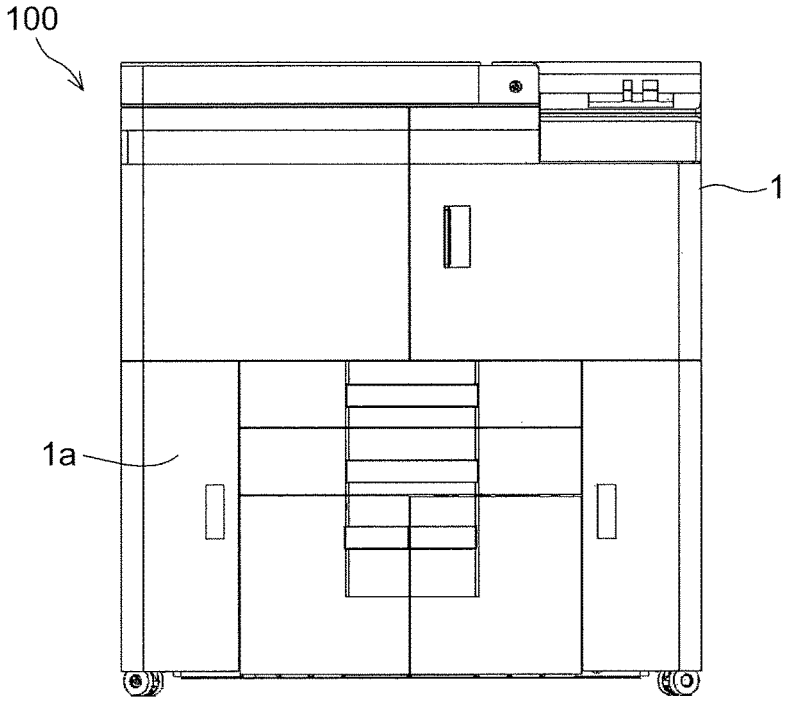
FIG. 6 is a view showing an appearance of the ink jet recording apparatus shown in FIG. 1.
Figure 7:
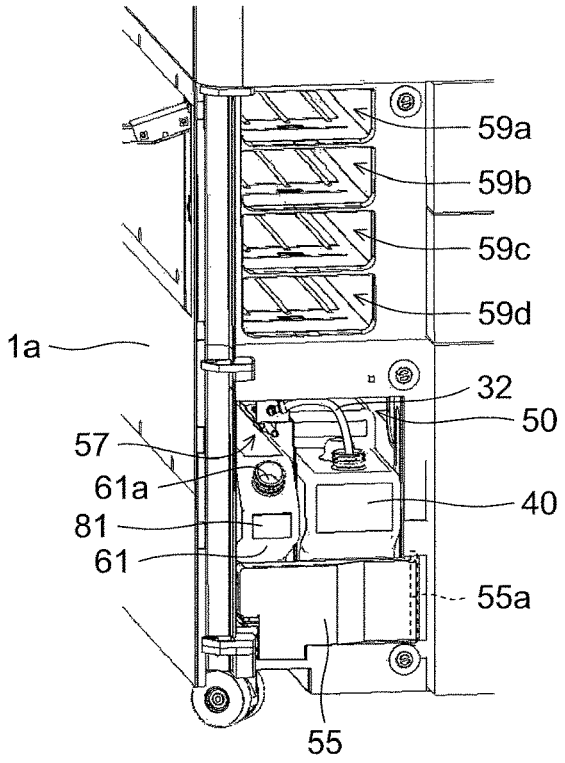
FIG. 7 is a view showing a configuration of around a main tank fitting part of the supply liquid tank unit according to one embodiment of the disclosure.

The main tank 81 is fitted to a main tank fitting part 57 (see FIG. 7) of the apparatus body 1. As shown in FIGS. 6 and 7, the main tank fitting part 57 is provided at a lower left place in the apparatus body 1 so as to be covered at its front side by an opening/closing cover 1*a* forming part of an exterior cover of the apparatus body 1.

Provided inside the opening/closing cover 1*a* are a waste-ink-tank fitting part 50, the main tank fitting part 57, and ink tank fitting parts 59*a* to 59*d*. The main tank fitting part 57 is placed adjacent to the waste-ink-tank fitting part 50, and allows the main tank 81 to be fitted thereto. The ink tank fitting parts 59*a* to 59*d* are placed upward of the waste-ink-tank fitting part 50 and the main tank fitting part 57, and allow individual-color ink tanks (not shown) to be fitted thereto. A tank cover 55 is provided in the waste-ink-tank fitting part 50 so as to be placed on the upstream side (front side, i.e., one side closer to the viewer of FIG. 7 drawing sheet) of the fitting direction of the waste ink tank 40 and the main tank 81.

The waste ink tank 40 for storing waste ink and waste cleaning liquid is removably fitted to the waste-ink-tank fitting part 50. A downstream end of the waste ink tube 32 allowing passage of paste waste ink and waste cleaning liquid is connected to the waste ink tank 40.

Figure 8:
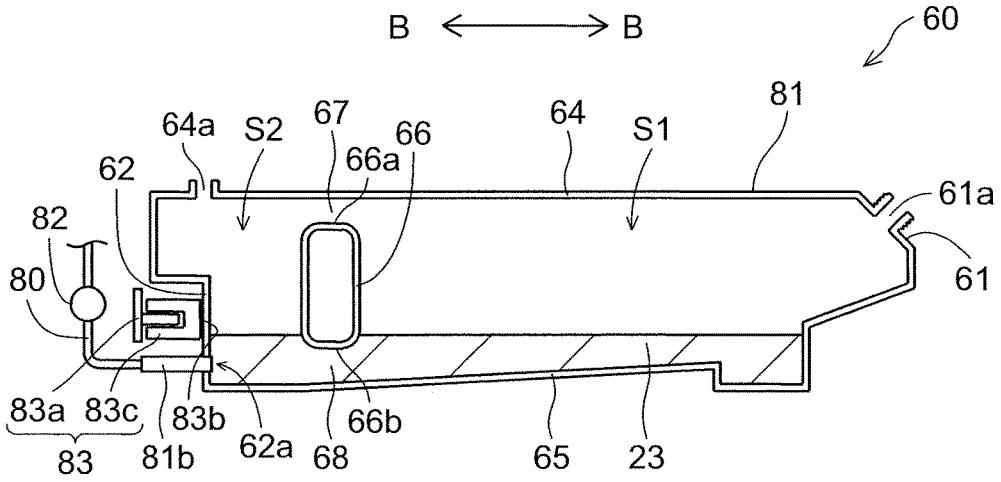
FIG. 8 is a view showing a configuration of the supply liquid tank unit according to one embodiment of the disclosure.
Figure 9:
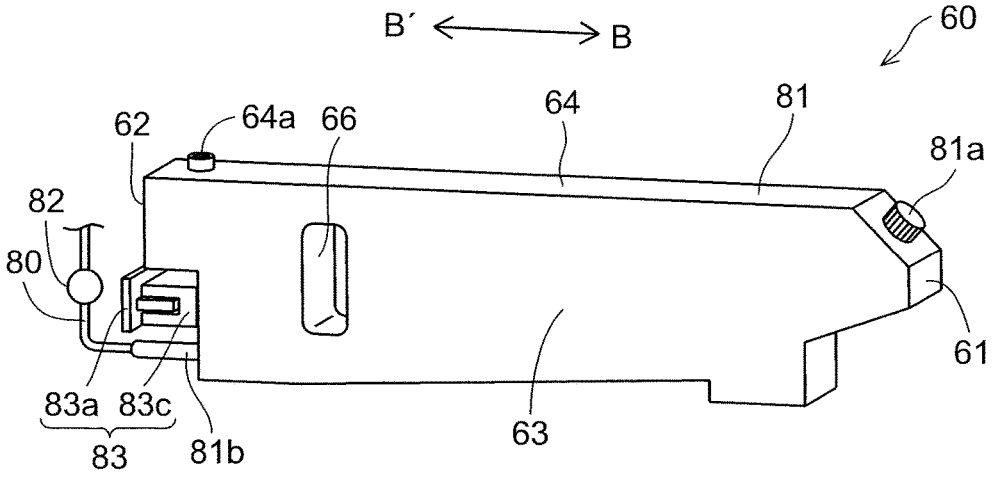
FIG. 9 is a view showing a configuration of the supply liquid tank unit according to one embodiment of the disclosure.
Figure 10:
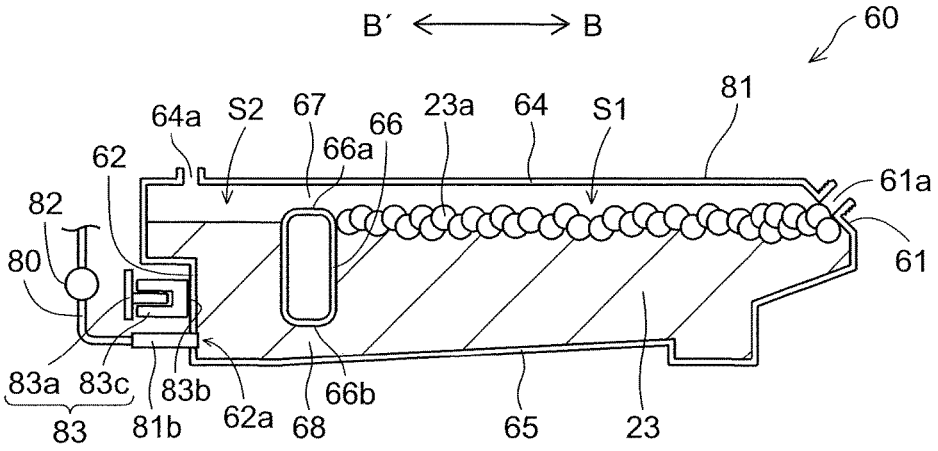
FIG. 10 is a view showing a configuration of the supply liquid tank unit according to one embodiment of the disclosure, illustrating a state in which cleaning liquid is resupplied through an inflow port.

As shown in FIGS. 8 and 9, the main tank 81 is formed into a slender shape extending along the back-and-forth direction (i.e., horizontal direction, direction perpendicular to drawing sheet of FIG. 6, arrow BB' direction). The main tank 81 has a front face (side face on the upstream side of the fitting direction (arrow B' direction)) 61, a back face (side face on the downstream side of the fitting direction) 62, a pair of side faces 63, an upper face 64, and a lower face 65.

The main tank 81 also has a first chamber S1 provided with an inflow port 61*a* for inflow of the cleaning liquid 23, a second chamber S2 provided with an outflow port 62*a* for outflow of the cleaning liquid 23, a partition wall 66 for partitioning between the first chamber S1 and the second chamber S2, an upper communicating path 67 placed above the partition wall 66 to make the first chamber S1 and the second chamber S2 communicating with each other, and a lower communicating path 68 placed below the partition wall 66 to make the first chamber S1 and the second chamber S2 communicating with each other.

The inflow port 61*a* is provided in the front face 61, which is one longitudinal end portion (end portion in arrow B direction) of the main tank 81. Normally (while the main tank 81 is out of resupply of the cleaning liquid 23), a cap 81*a* (see FIG. 9) is attached to the inflow port 61*a*.

The outflow port 62*a* is provided in the back face 62, which is the other longitudinal end portion (end portion in arrow B' direction) of the main tank 81. A connecting tube 81*b* connected to an upstream end of the cleaning liquid resupply path 80 is fitted to the outflow port 62*a*.

An atmospheric air opening 64*a* for equalizing internal pressures of the first chamber S1 and the second chamber S2 with the atmospheric pressure is provided in the upper face 64. A filter (not shown) for suppressing intrusion of dust or other foreign matters into the main tank 81 is provided at the atmospheric air opening 64*a*.

A second detection sensor 83 is placed in proximity to the back face 62. That is, the second detection sensor 83 detects a liquid level of the cleaning liquid 23 in the second chamber S2. The second detection sensor 83 has a fixed part 83*a* positioned and fixed at the frame (not shown) of the main tank fitting part 57, and a detection part 83*c* having a detection surface 83*b* for detecting a liquid quantity within the main tank 81. The detection part 83*c* is made back-and-forth (arrow BB' direction) slidable relative to the fixed part 83*a*, and is biased by a biasing member (not shown) toward the back face 62 of the main tank 81. As a result, in the state that the main tank 81 is fitted to the main tank fitting part 57 (i.e., state of FIGS. 8 and 9), the second detection sensor 83 is in contact with the back face 62, so that the distance from the detection surface 83*b* to the main tank 81 is maintained constant.

The detection surface 83*b* is so formed that its widthwise (direction perpendicular to the drawing sheet of FIG. 8) length becomes equal to, or larger than, widthwise lengths of the first chamber S1 and the second chamber S2 of the main tank 81. The second detection sensor 83 is enabled to detect the liquid level of the cleaning liquid 23 in the main tank 81 as far as the detection range is within the height of the detection surface 83*b*. The second detection sensor 83 transmits a detection result to the control unit 110.

The partition wall 66 is formed into such a generally rectangular shape as to connect the pair of side faces 63 to each other and to extend up and down, i.e. vertically, with a void formed inside. The partition wall 66 is placed closer to the outflow port 62*a* than an intermediate position between the inflow port 61*a* and the outflow port 62*a* is to the outflow port 62*a*. The upper communicating path 67 is formed from the upper face 64, an upper end 66*a* of the partition wall 66, and the pair of side faces 63. The lower communicating path 68 is formed from the lower face 65, a lower end 66*b* of the partition wall 66, and the pair of side faces 63.

In this case, a lower end of the detection surface 83*b* of the second detection sensor 83 is placed above the lower end 66*b* of the partition wall 66. Also, the outflow port 62*a* is placed below the second detection sensor 83 and moreover below the lower end 66*b* of the partition wall 66.

As shown in FIG. 7, the tank cover 55 is pivotable about a pivotal shaft 55*a*. With the tank cover 55 closed (state of FIG. 7), the tank cover 55 is in contact with the front face of the waste ink tank 40 as well as with the front face 61 of the main tank 81, the waste ink tank 40 is placed at a specified position in the waste-ink-tank fitting part 50, and the main tank 81 is placed at a specified position in the main tank fitting part 57. Then, as shown in FIG. 8, the second detection sensor 83 is put into contact with the back face 62 of the main tank 81.

In this ink jet recording apparatus 100, when the liquid level of the cleaning liquid 23 in the main tank 81 has reached a specified position (e.g., position of FIG. 8), a notification that the main tank 81 has emptied (or remaining quantity of cleaning liquid 23 has come to a poor level) is given on the display panel (not shown) of the ink jet recording apparatus 100. As a result, the cleaning liquid 23 is additionally supplied (resupplied) to the main tank 81 by the user or operator.

More specifically, by the user or operator, the opening/closing cover 1*a* (see FIG. 7) is opened and the cap 81*a* is removed from the inflow port 61*a*. Then, the cleaning liquid 23 is resupplied into the inflow port 61*a* from a resupply bottle (not shown) containing a specified quantity (quantity of one-time resupply) of the cleaning liquid 23. In this process, the cleaning liquid 23 foams in the first chamber S1, causing air bubbles on the liquid surface (see FIG. 10). However, since the lower end 66*b* of the partition wall 66 is placed below the liquid level of the cleaning liquid 23, the air bubbles 23*a* do not move to the second chamber S2. Thereafter, the cleaning liquid 23 is resupplied until the resupply bottle (not shown) is emptied, resulting in the state of FIG. 10. Then, after the cap 81*a* is attached to the inflow port 61*a*, the opening/closing cover 1*a* is closed, where the resupply work for the cleaning liquid 23 is ended.

In this embodiment, as described above, the main tank 81 includes the first chamber S1 provided with the inflow port 61*a*, the second chamber S2 provided with the outflow port 62*a*, and the partition wall 66 for partitioning between the first chamber S1 and the second chamber S2. The second detection sensor 83, which detects the liquid level of the cleaning liquid 23 in the second chamber S2, is placed above the lower end 66*b* of the partition wall 66. As a result of this, even when the cleaning liquid 23 has foamed during the resupply of the cleaning liquid 23 through the inflow port 61*a*, the air bubbles 23*a* float to the liquid surface, so that movement of the air bubbles 23*a* from the first chamber S1 to the second chamber S2 can be suppressed by the partition wall 66. Thus, misdetections of the liquid level of the cleaning liquid 23 in the main tank 81 by the second detection sensor 83 can be suppressed.

Further, since intrusion of the air bubbles 23*a* into the second chamber S2 can be suppressed, outflow of the air bubbles 23*a* through the outflow port 62*a* can also be suppressed. As a result of this, the possibility of decreases in the quantity of the cleaning liquid 23 flowing out through the outflow port 62*a* can be suppressed. Also, intrusion of the air bubbles 23*a* into the sub tank 71 can be suppressed. Thus, it is made possible to suppress any misdetections of the liquid level of the cleaning liquid 23 in the sub tank 71 by the first detection sensor 73 as well as decreases in the quantity of the cleaning liquid 23 supplied to the recording heads 17 due to outflow of the air bubbles 23*a* from the sub tank 71.

Furthermore, as described above, the partition wall 66 is placed closer to the outflow port 62*a* than the intermediate position between the inflow port 61*a* and the outflow port 62*a* is to the outflow port 62*a*. As a result of this, since the partition wall 66 can be placed far from the inflow port 61*a*, it is made possible to suppress movement of the air bubbles 23*a* from the first chamber S1 to the second chamber S2 to more extent even when the cleaning liquid 23 has foamed during the resupply of the cleaning liquid 23 through the inflow port 61*a*.

Further, as described above, the main tank 81 includes the upper communicating path 67 which is placed above the partition wall 66 and which makes the first chamber S1 and the second chamber S2 communicating with each other. As a result of this, during the resupply of the cleaning liquid 23 to the main tank 81, as the cleaning liquid 23 moves from the first chamber S1 to the second chamber S2 via the lower communicating path 68, air moves from the second chamber S2 to the first chamber S1 via the upper communicating path 67. Thus, the cleaning liquid 23 can be moved smoothly from the first chamber S1 to the second chamber S2 with a simple structure, and moreover the liquid level of the first chamber S1 and the liquid level of the second chamber S2 can be easily made flush with each other.

Furthermore, as described above, the outflow port 62*a* is placed below the lower end 66*b* of the partition wall 66. As a result of this, the outflow port 62*a* can be placed downwardly farther from the liquid level of the cleaning liquid 23 than in the case where the outflow port 62*a* is placed above the lower end 66*b* of the partition wall 66. Therefore, even when the air bubbles 23*a* have intruded into the second chamber S2 for some cause, it is possible to suppress outflow of the air bubbles 23*a* through the outflow port 62*a*.

Furthermore, as described above, the atmospheric air opening 64*a* that equalizes internal pressures of the first chamber S1 and the second chamber S2 with the atmospheric pressure is provided in the upper face 64 of the main tank 81. As a result of this, the main tank 81 can be prevented from internally going negative pressure during outflow of the cleaning liquid 23 through the outflow port 62*a*. Thus, the possibility that outflow of the cleaning liquid 23 through the outflow port 62*a* is retarded due to the negative pressure can be prevented.

Furthermore, as described above, the inflow port 61*a* is provided at one longitudinal end portion of the main tank 81, and the outflow port 62*a* is provided at the other longitudinal end portion of the main tank 81. As a result of this, since the inflow port 61*a* and the outflow port 62*a* can be placed far from each other, enough distance from the inflow port 61*a* to the partition wall 66 can be ensured. Therefore, even when the cleaning liquid 23 has foamed during the resupply of the cleaning liquid 23 through the inflow port 61*a*, movement of the air bubbles 23*a* from the first chamber S1 to the second chamber S2 can be suppressed to more extent.

Furthermore, as described above, the main tank 81 for containing the cleaning liquid 23, when having emptied, is more often resupplied with the cleaning liquid 23 not by replacement with new one but by additional supply, it is more likely that the cleaning liquid 23 may foam in the main tank 81. Therefore, this disclosure is particularly effective when applied to cases in which the main tank 81 for containing the cleaning liquid 23 is used.

The embodiment disclosed herein should be construed as not being limitative but being an exemplification at all points. The scope of the disclosure is defined not by the above description of the embodiment but by the appended claims, including all changes and modifications equivalent in sense and range to the claims.

For example, the foregoing embodiment has been described on an example in which the disclosure is applied to the main tank 81 for containing the cleaning liquid 23. However, the disclosure is not limited to this. The disclosure may be applied to an ink tank for containing ink (liquid). The disclosure may also be applied to the sub tank 71.

Also, the foregoing embodiment has been described on an example in which the cleaning liquid 23 is supplied to the recording heads 17 from the main tank 81 via the sub tank 71. However, the disclosure is not limited to this. With no sub tank 71 provided, the cleaning liquid 23 may be supplied directly from the main tank 81 to the recording heads 17.

Also, the foregoing embodiment has been described on an example in which the atmospheric air opening 64*a* is provided in the upper face 64 of the main tank 81. However, the disclosure is not limited to this. For example, the inflow port 61*a* may be utilized as an atmospheric air opening by not attaching the cap 81*a* to the inflow port 61*a* or by providing a small air hole in the cap 81*a*.

Also, the foregoing embodiment has been described on an example in which the upper communicating path 67 is provided above the partition wall 66. However, the disclosure is not limited to this. In this case, the atmospheric air opening 64*a* may be provided in each of the first chamber S1 and the second chamber S2. It is also allowable to provide the atmospheric air opening 64*a* in the second chamber S2 and moreover utilize the inflow port 61*a* as an atmospheric air opening.

What is claimed is:

1. A supply liquid tank unit comprising:

a supply liquid tank for containing cleaning liquid for cleaning a recording head to be supplied to the recording head that ejects ink onto a recording medium; and a detection sensor for detecting a liquid level of the cleaning liquid in the supply liquid tank, wherein the supply liquid tank includes:

a first chamber provided with an inflow port allowing inflow of the cleaning liquid;

a second chamber provided with an outflow port allowing outflow of the cleaning liquid;

a partition wall for partitioning the first chamber and the second chamber from each other; and a lower communicating path which is formed from a lower end of the partition wall and a lower surface of the supply liquid tank and which makes the first chamber and the second chamber communicating with each other, the outflow port is placed below the detection sensor, the detection sensor detects a liquid level of the cleaning liquid in the second chamber, and is placed above the lower end of the partition wall, and the inflow port is placed at a higher position than the outflow port.

2. The supply liquid tank unit according to claim 1, wherein the partition wall is placed closer to the outflow port than an intermediate position between the inflow port and the outflow port.

3. The supply liquid tank unit according to claim 1, wherein the supply liquid tank further includes an upper communicating path which is formed from an upper end of the partition wall and an upper surface of the supply liquid tank and which makes the first chamber and the second chamber communicating with each other.

4. The supply liquid tank unit according to claim 1, wherein the outflow port is placed below the lower end of the partition wall.

5. The supply liquid tank unit according to claim 1, wherein the supply liquid tank is formed so as to extend horizontally, the inflow port is provided at one longitudinal end portion of the supply liquid tank, and the outflow port is provided at the other longitudinal end portion of the supply liquid tank.

6. The supply liquid tank unit according to claim 1, wherein the entire detection sensor is placed below an upper end of the partition wall.

7. The supply liquid tank unit according to claim 1, wherein the lower surface includes an inclined surface, the lower communicating path is formed by the lower end of the partition wall and the inclined surface, and the inclined surface is inclined downward in a direction from the first chamber to the second chamber.

8. The supply liquid tank unit according to claim 1, wherein the supply liquid tank includes a pair of side surfaces, and the partition wall connects together the pair of side surfaces and has a void formed inside.

9. The supply liquid tank unit according to claim 1, wherein part of the inflow port is placed at a same height as an upper end of the partition wall.

10. The supply liquid tank unit according to claim 1, wherein an atmospheric air opening for equalizing internal pressures of the first chamber and the second chamber with atmospheric pressure is provided in an upper surface of the supply liquid tank.

11. The supply liquid tank unit according to claim 10, wherein the inflow port is arranged at a lower position than the atmospheric air opening.

12. An ink jet recording apparatus comprising:

the supply liquid tank unit according to claim 1; and the recording head for ejecting ink onto the recording medium.

13. The ink jet recording apparatus according to claim 12, further comprising a wiper, wherein the recording head includes a head portion that ejects the ink and a cleaning liquid supply member that supplies the cleaning liquid, the cleaning liquid supply member is placed adjacent to the head portion on an upstream side thereof in a wiping direction of the wiper, and the wiper wipes an ink ejection surface of the head portion while holding the cleaning liquid.

* * * * *